US006220693B1

(12) United States Patent
Bode et al.

(10) Patent No.: US 6,220,693 B1
(45) Date of Patent: Apr. 24, 2001

(54) OVERSPRAY ADAPTATION METHOD AND APPARATUS FOR AN INK JET PRINT ENGINE

(75) Inventors: John Hans Bode, Eden Prairie; Danny James Vatland, Chanhassen; Henry Victor Holec, Mendota Heights; Benjamin Patrick Leonard, Saint Paul; Robert Anthony Laumeyer, Minneapolis, all of MN (US)

(73) Assignee: ColorSpan Corporation, Eden Prairie, MN (US)

( * ) Notice: Subject to any disclaimer, the term of this patent is extended or adjusted under 35 U.S.C. 154(b) by 0 days.

(21) Appl. No.: 08/939,561

(22) Filed: Sep. 29, 1997

(51) Int. Cl.[7] ..... B41J 2/165
(52) U.S. Cl. ..... 347/34
(58) Field of Search ..... 347/34, 33, 21, 347/77

(56) References Cited

U.S. PATENT DOCUMENTS 3,938,163 2/1976 Fujimoto et al. ..... 347/77

FOREIGN PATENT DOCUMENTS 358104758 6/1983 (JP) ..... 347/21

*Primary Examiner*—John Barlow
*Assistant Examiner*—Charles W. Stewart, Jr.
(74) *Attorney, Agent, or Firm*—Paul H. McDowall

(57) ABSTRACT

The present invention relates to a method and apparatus for printing digital color images with non-impact print heads whereby fluid flowing at a relatively high velocity proximate ink emitting nozzles affects flight trajectories of undesirable satellite ink droplets incidentally emitted from the nozzles, but does not affect flight trajectories of primary droplets. In one embodiment, a single fluid deflector member oriented upstream of the print head causes fluid flow intermediate the print head and the printing surface and urges the satellites to a preferred location on the printing media. In another embodiment, at least one additional deflector member is oriented to cooperate with the deflector member to ensure that such satellites encounter a forced fluid flow intermediate the print head and print surface. In yet another embodiment, a source of fluid pressure is used to create the relatively high velocity fluid flow that interacts with satellite droplets to guide them to a preferred location on the printing media. The present invention greatly improves precision and predictability in forming primary marks on the printing media by selectively redirecting only satellite ink droplets to record upon the printing media as close as possible to (and ideally to coincide with) the primary mark at a common location so that high quality text, graphics, and accurate color images result.

6 Claims, 13 Drawing Sheets

WITHOUT FAN

WITH FAN

OVERSPRAY ADAPTATION METHOD AND APPARATUS FOR AN INK JET PRINT ENGINE

FIELD OF THE INVENTION

The present invention relates generally to the field of printing. In particular, a method and apparatus for beneficially modifying the trajectories of a plurality of undesirable secondary and tertiary ink droplets which accompany a primary ink droplet emitted during non-impact printing operations.

BACKGROUND OF THE INVENTION

The present invention addresses a long standing obstacle to optimized visual clarity in high speed digital continuous and drop-on-demand ink jet printing where output is created by a plurality of primary ink droplets emitted during an energizing sequence to ink emitting nozzles of print cartridges disposed in an ink jet print engine. Such primary droplets are typically accompanied by secondary and tertiary ink ("satellite") droplets which create undesirable image defects when said satellite droplets register upon a printing media at locations other than a desired primary mark location. A primary droplet is emitted under precise electronic control typically as a result of a energy pulse received by an ink emitting nozzle to thus impart a preselected trajectory and time of flight to the primary droplet. When a one of a plurality of nozzles are energized a primary ink droplet accelerates toward a preselected location on a printing media, typically trailed by one or more satellite droplets. Typically, such satellite droplets form at the tail of the primary droplet and may precede or trail each primary droplet in flight, although the manner of satellite droplet formation is immaterial for purposes of understanding the background of the present invention. Although in practice some satellite droplets may merge back into a primary droplet, at least a portion of said satellite droplets often register on the printing media outside a boundary of each primary mark created by each primary droplet and thus reduce edge clarity of said primary marks and thus overall text quality and color fidelity of a printed image. This phenomenon shall be referred to herein as "Overspray" which term shall include all those visual artifacts described and depicted herein, as well as other visual artifacts created when emitting droplets of any marking material to register precisely upon a print substrate, or an intermediate substrate, and said visual artifacts are attributable to satellite droplets.

In the prior art related to ink jet printing, a print head operated under precise electronic control typically opposes a portion of printing media so that an image may be printed thereon. Some representative prior art approaches to controlling or alleviating undesirable image artifacts created by satellite droplets include: adjustment to the excitation signal wave form to inhibit satellite formation by applying certain harmonic frequencies to a continuous jet stream as in U.S. Pat. No. 3,928,855; forming a modified nozzle face portion for emitting primary droplets to thereby minimize satellite formation as in U.S. Pat. No. 5,057,853; laser trimming ink droplet emission circuitry for each of a plurality of nozzle rows and/or otherwise adjusting the magnitude of an excitation signal to thus improve efficiency and consistency of primary droplet formation as in U.S. Pat. No. 5,389,956; and applying electrostatic charging to influence both primary and satellite droplets as in U.S. Pat. No. 5,489,929. On the whole these patents provide a perspective on controlling or minimizing formation of satellite droplets, in contrast to the present invention which assumes that ink jet printing typically produces an appreciable volume of satellite droplets.

In the relevant prior art, control of satellite droplets has not generally depended upon the type of digital print engine used to emit ink onto a printing media. In this respect both the prior art and the present invention apply without limitation to drum-based, reciprocating swath (or carriage-based) print engines, and flat bed-based digital print engines. In a drum-based print engine a print media attaches to a rotating drum which repeatedly passes under one or more discrete ink emitting print elements ("nozzles") mounted on a carriage articulated in the axial direction. In a reciprocating swath, or carriage-based, print engine the media is incrementally stepped over a fixed platen surface in one direction while the nozzles reciprocate across the media in a direction orthogonal to the direction the media advances. In a flat bed print engine, the printing media is typically rigidly coupled to a substantially planar surface and the nozzles are articulated in two dimensions to cover the media. In each of these types of prior art print engine mechanisms, the nozzles are spaced from and thus do not contact the printing media as the print head dispenses ink upon the print media to form an image. When such spacing is minimized, it is known that satellite formation and the resulting image defects are reduced; however, with less spacing between the nozzles and the printing media the likelihood and severity of damaging contact between the nozzles and printing media increases. Nevertheless, in all said prior art print engines an appreciable number of satellite droplets register upon the media and thus inhibit the clarity of printed output from said print engines.

In all such traditional drop-on-demand print engines, electronic control operates to impart a known trajectory profile to each said primary droplet emitted from the nozzles to accurately control primary droplets. The manner and effectiveness of imparting such a known trajectory profile to a primary droplet is not altered or modified herein, although some considerations for primary droplet placement typically include: time for a drive pulse to reach a firing chamber proximate an ink emitting nozzle, the time for ink to fill an ink firing chamber, the time for a nozzle to physically emit a primary ink droplet, a velocity of the emitted primary ink droplet, an expected time of flight of the primary ink droplet, and relative velocity of the print media and nozzles, among others. To the inventors knowledge, no prior art approach actually compensates and controls satellite droplets once they form and are otherwise likely to register in undesired locations on the printing media with either a column of relatively high velocity fluid or through implementing one or more fluid deflector members.

Thus, a need exists in the art of drop-on-demand ink jet and continuous ink jet printing to compensate for satellite droplets formed incidentally during formation of primary ink droplets in order to improve the quality and the visual clarity of text, graphics, and color appearing on print media. Further, a need exists in the art for a method and apparatus to reduce the visual impact of said satellite droplets whether or not additional satellite droplet reduction measures are undertaken.

SUMMARY OF THE INVENTION

The present invention discloses and teaches a method and apparatus for precisely controlling satellite ink droplets expelled from one or more ink jet print heads by expelling a relatively high velocity fluid flow present into a three-dimensional space (the "zone of fluid influence" herein)

defined on one side by a discrete surface portion of print media and a substantially planar surface at which the nozzles of each print head are oriented directly opposing said surface portion of print media. In a first embodiment, said control of satellite droplets is passively conducted via a single fluid obstruction member disposed adjacent and on a side of a print head. In a second embodiment, a combination of fluid obstruction members cooperate to suitably condition the satellite droplets flight trajectory and marking location on the printing media. In a third embodiment, a fluid velocity generating source provides a directed flow of fluid via one or more fluid exit ports to selectively control said satellite droplets in the vicinity of nozzles and both with and without use of one or more passive fluid obstruction member(s) of the other embodiments. In one form of this third embodiment, said fluid velocity generating source may be modular, detachable, remotely coupled, and/or reconfigurable to accommodate various types of print engines. The inventors specifically include a discrete embodiment adapted for a traditional reciprocating swath, or carriage-type, print engine wherein two opposing fluid exit ports, whether or not using a common source of fluid velocity, are alternately operated during printing operations.

For purposes of explanation herein, the present invention can be viewed as relating generally to non-impact color printing. One of skill in the digital imaging arts will certainly realize that the benefits of the teaching of the present invention reach many types of ink non-impact printing, including drop on demand and continuous, whether thermally, piezoelectrically, or acoustically driven. The apparatus and printing techniques of the present invention improve performance of precisely controlled ink emitting nozzles operating in conjunction to form graphics, text, and a wide gamut of colored output on a variety of printing media of varying thickness. A full image forms as a result of a series of individual passes of a print carriage over the printing media while the nozzles are selectively energized. In one embodiment of the present invention, eight replaceable ink jet cartridges, each having at least fifty (50) ink emitting nozzles are controlled to perform very high speed printing of digital color images by selectively emitting primary ink droplets. This invention deals directly with the plurality of satellite ink droplets which accompany the primary ink droplets and which register near the primary mark.

The method and apparatus of the present invention thus increases the precision for controlling a plurality of satellite ink droplets incidentally emitted from an ink jet print head in a digital print engine. The present invention addresses a phenomenon termed "Overspray" herein, which presents a persistent obstacle to obtaining good image and text print quality with traditional ink jet print engines. By controlling the velocity and direction of a forced flow of air, or other fluid material, in a droplet flight zone between an ink jet cartridge and a printing medium (the "zone of fluid influence") to reduce the visual impact of undesirable satellite droplets without interfering with positional accuracy of said primary ink droplets.

The present invention addresses Overspray in an ink jet printer as an incidental image quality defect in which there are several relatively small satellites of ink that trail the main, or primary, droplet. Observations of Overspray include image output where Overspray is visually manifested in text and trailing edges of dark areas on an image, and tends to get progressively worse for higher print speeds and for increased print head height relative to the printing media (due largely to varying media thickness and/or to adjustable print head heights). For certain dye-based inks Overspray often creates image defects most readily perceived in the darkest inks, or just generally not evenly distributed between the various colors, of an image printed on the printing media. Subjectively evaluating this phenomenon for a set of eight exemplary multi-concentration colored inks yields the following relative percentages of perceived Overspray (indicated first by ink color(s) and then the total aggregate percent of Overspray related to the color(s)): black ink—40%; heavy concentration magenta and heavy concentration cyan ink—20%; medium concentration magenta and medium concentration cyan ink—15%; light concentration magenta, light concentration cyan, and yellow ink—5%.

The present invention is directed to the general goal of effectively minimizing Overspray for any given print cartridge operating in a print engine by increasing the average velocity of air flowing between the surface of the print media and a surface surrounding the ink emitting nozzles ("orifice plate") to approximately three to four times (3× to 4×) a relative velocity of movement between a portion of printing media to be printed and said nozzles, such that the fluid flow moves in the same direction as the printing media. For example, for a sixty inch per second ("60 ips") rotational speed of a drum disposed in a drum-based print engine, the average fluid velocity should be increased to between 180 to 240 ips directly below the ink emitting nozzles located in an orifice plate. This average velocity of the fluid flow has been empirically determined by observing recorded image quality, measuring droplet size and location, and measuring fluid velocity during printing using a point-style analog anemometer, among other techniques that provided empirical results herein. Given different spacing, droplet and/or carriage velocity, droplet size, etc. the inventors believe successful results can be easily achieved with iterative testing and/or computational techniques to model droplet behavior.

The present invention thus finds utility for a variety of printing platforms that operate under well understood control parameters to accurately direct each of a plurality of primary droplets to a variety of desired locations upon a printing media. In a preferred embodiment of the present invention, a carriage assembly of a non-impact print engine employs several fluid passageways to convey fluid to one or more exit ports so that the fluid interacts and influences the trajectories of said satellite droplets, while the primary droplets substantially follow their preselected trajectory profiles.

Although not confirmed to date by thorough testing and analysis, the inventors suspect that a possible reason why applying such a fluid flow effects Overspray only, and does not seem to appreciably deflect primary droplets (nor degrade image quality) relate to the following:

- Satellite droplets typically contain a volume of ink totaling roughly under fifty picoliters (<50 pl) and are thus more sensitive to trajectory path deflection due to air flow friction than the typically larger primary droplets (~150 pl).
- Smaller satellite droplets typically travel at lower velocity than primary droplets, and thus remain suspended in the air for a longer period of time, and can therefore be influenced for a longer period of time by the measures described herein.
- Video camera observation and slow motion replay of nozzles emitting primary and satellite droplets during testing of different iterations of the present invention confirms the inventors' thesis.

The inventors further observed that the effectiveness of the present invention to compensate only satellite droplets remains robust to changes in the spacing between the nozzles and the printing media in a range approximately between 0.010" to 0.100".

Of course, the inventive method and apparatus may be applied in numerous ways apparent to one of skill in the digital printing art. For example, the essence of the present invention is to create a zone of fluid influence proximate ink emitting nozzles to minimize image defects due to satellite droplets. Accordingly, either a passive fluid deflector member and/or a fluid of relatively constant exit velocity ported to create said zone of fluid influence and thereby adapt, modify, and thus control the flight of said satellite droplets can be used when practicing the present invention. Alternately, a fluid under a time-varying pressurization sequence can be applied to compensate for acceleration and deceleration of printheads (and therefore satellite droplets) with respect to a print engine, and other variations as apparent to one of skill in the art.

For example, given a preselected printing mode in a drum-based print engine, which typically includes a constant rotational velocity of the drum, and a translational velocity of the carriage, and a nozzle energization frequency of typically between 2.5–12 kHz per nozzle, the method and apparatus of the present invention controls and limits image quality defects associated with satellite droplets. The inventors recognize that for certain applications, such as continuous ink jet printing, substantially higher nozzle energization frequencies may be suitable, and will also benefit from the teaching of the present invention. In one embodiment a fluid conditioning member obstructs a layer of fluid present adjacent the printing surface to thereby passively redirect the satellite droplets. But the preferred active system taught herein has a pressurized supply of fluid expelled into the zone of fluid influence, at a rate roughly equal to roughly three times (3×) the rate of relative motion between a fixed location on the printing media and the nozzles, so that the satellite droplets settle on and/or nearer the primary mark. This supply of fluid is preferably expelled with a flow velocity and direction aligned with the direction of relative movement between the nozzles and the printing media.

In summary, highly accurate, repeatable, and predictable placement of satellite droplets during passes of a print carriage in a non-impact print engine in accordance with the present invention generates image output wherein an increased number of satellite droplets mark pixel locations corresponding to desired primary marks.

In a preferred embodiment, the digital printing system contains eight ink jet cartridges, print head control circuitry, and a source of high velocity fluid, all mounted on an axially driven carriage assembly and the printing system comprises a chassis, and a separate electronics portion, a print area portion, a consumable portion, as depicted in FIG. 11. In one form of this preferred embodiment only the heaviest concentration ink marking material receives Overspray compensation pursuant to the present invention, thus resulting in a lightweight, compact, and efficient implementation of the present invention.

The following figures are not drawn to scale and only detail a few representative embodiments of the present invention, more embodiments and equivalents of the representative embodiments depicted herein are easily ascertainable by persons of skill in the digital imaging arts.

DESCRIPTION OF THE PREFERRED EMBODIMENT

Figure 11:
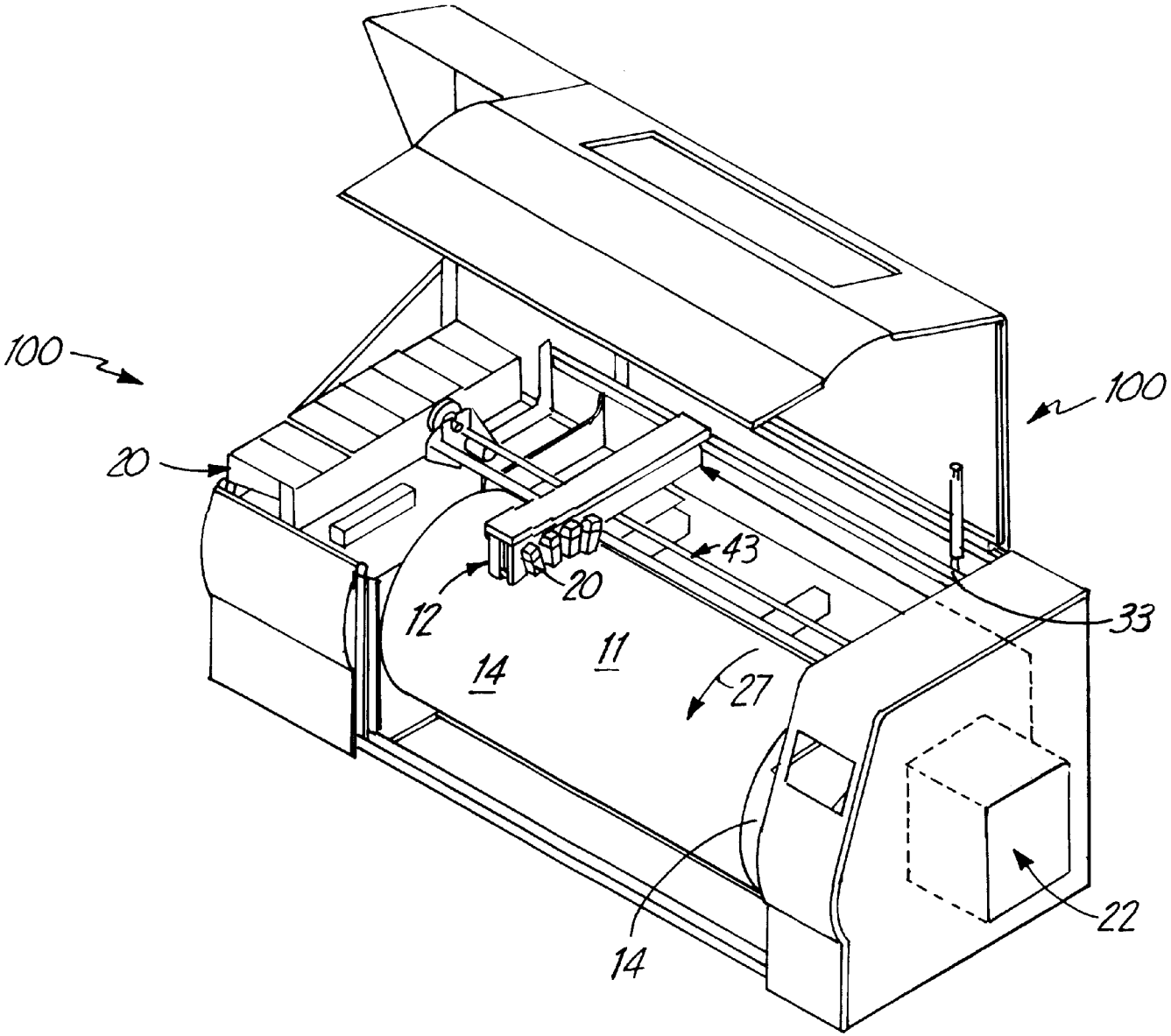
FIG. 11 is a perspective view of a drum-based digital print engine suitable for using the method and incorporating the apparatus of the present invention in an integrated print cartridge carriage subassembly.
Figure 12A:
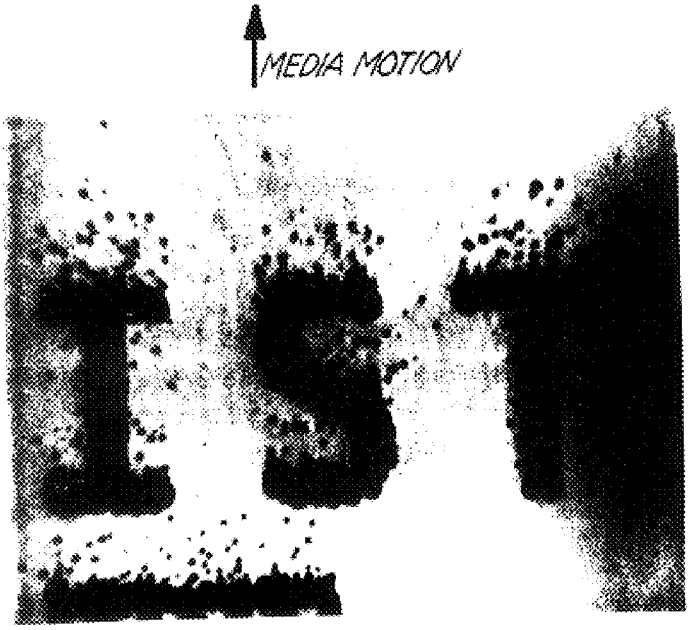
FIG. 12 are two calibration patterns and two photographs showing enlarged views of portions of said two calibration patterns, the pattern labeled "A" and the photograph labeled "B" depict printed output of the prior art, and the pattern labeled "Y" and the photograph labeled "Z" depict printed output produced with the method and apparatus of the present invention.
Figure 12B:
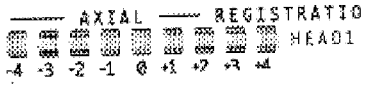
Figure 12Z:
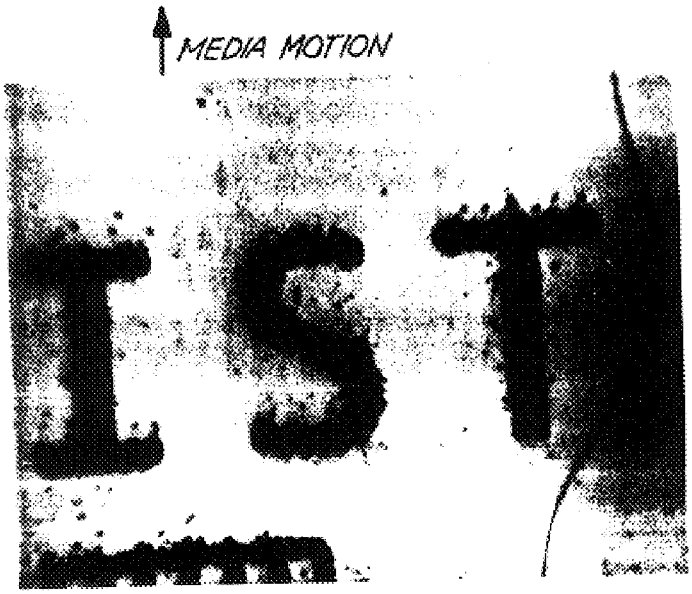
Figure 12Y:
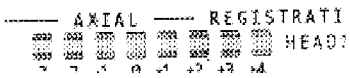
Figure 13:
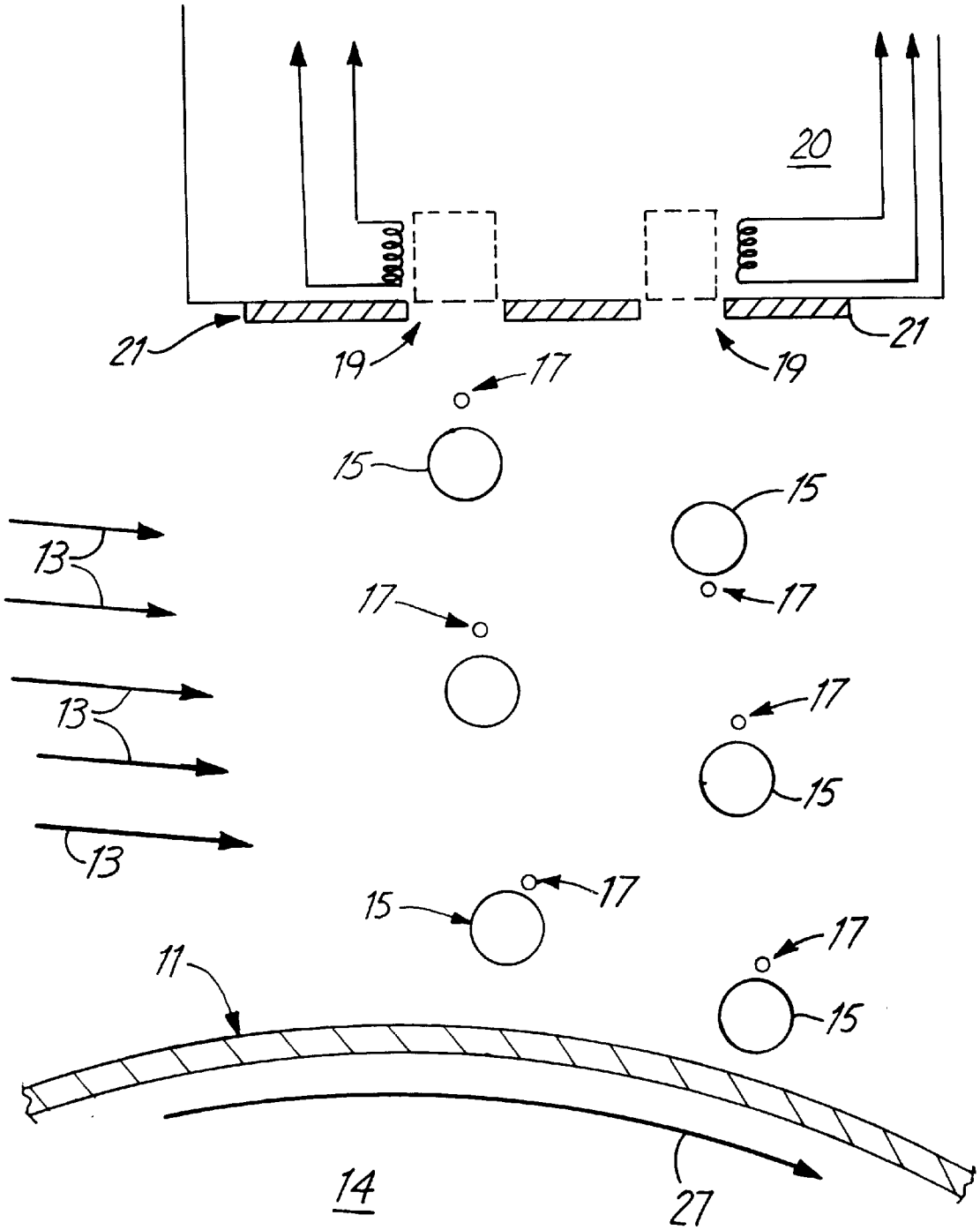
FIG. 13 is an elvational side view, enlarged for clarity, of the zone of fluid influence (as defined herein) where a high velocity fluid flow interacts with satellite droplets between an emitting nozzle and a revolving print media.

The present invention is described primarily with reference to a drum-based ink jet print engine 100 similar to that depicted in FIG. 11 which employs multiple print cartridges 20 and wherein the velocity of a print media-bearing rotating drum 14 typically is preset and non-adjustable during printing operations. It should be readily apparent that the teaching herein can be applied to a variety of ink jet print engines that emit droplets of ink or other colorant onto a print media 11. While not specifically depicted herein, one of skill in the art will certainly appreciate that the teaching of the present invention applies directly to swath, or carriage-based, ink jet printers that include predictable periodic acceleration and deceleration velocity profiles for the print head during the printing of each print swath upon a media substrate. Furthermore, although not detailed herein, the inventors intend the present invention to apply to drum-based printers operating to vary print head velocity during printing operations, wherein a controllable flow producing device creates a dynamically adaptive fluid flow to decrease Overspray and other image quality defects at varying print speeds.

The present invention covers the controlled interaction of a selected flow of a fluid (denoted by arrow 13) with satellite ink droplets 17 during the period of time such droplets are airborne between a nozzle 19 of a print head 20 and a print media 11 in said zone of fluid influence. Fluid flow 13 can be either a passive by-product of drum-rotation in some embodiments herein (see FIG. 1–3), or an artificially-created active flow of a fluid produced, for example by a blower or fan. In either embodiment, one or more directed fluid flows encounter the primary 15 and satellite 17 droplets immediately upon emission from a printing orifice plate 21, for example, and continue to deflect only said satellite droplets 17 until each satellite droplet 17 records upon the print media 11. Thus, the satellite droplets are urged to land as close as possible to the preselected primary mark location on the print media 11. In a preferred mode, ambient air is the selected fluid and a blower fan is used to create fluid flow 13 to urge the satellite droplets 17 to conform to the desired mark location. Of course, purified, particulate-free, heated, cooled, inert fluids, and/or a combination of same present a reasonable alternative to use of ambient air as fluid 13 in the artificially-created fluid flow embodiments.

The reader is encouraged to cross reference and review the present document with U.S. patent application assigned to LaserMaster Corporation of Eden Prairie, Minn, USA the contents of said application is hereby incorporated by reference herein: U.S. Ser. No. 08/711,796, titled "Cooperating Mechanical Sub-assemblies for a Drum-based Wide Format Digital Color Print Engine." Furthermore, applicant herein incorporates U.S. Pat. No. 5,369,429 titled "Continuous Ink Refill System for Disposable Ink Jet Cartridges Having a Predetermined Ink Capacity" and U.S. Pat. No. 5,469,201 directed to a guideway for a continuous ink refill system, both of which are commonly assigned to LaserMaster Corporation. These references teach, enable, and claim a preferred mode of providing ink to carriage mounted print heads for a variety of wide format ink jet print engines.

Figure 1C:
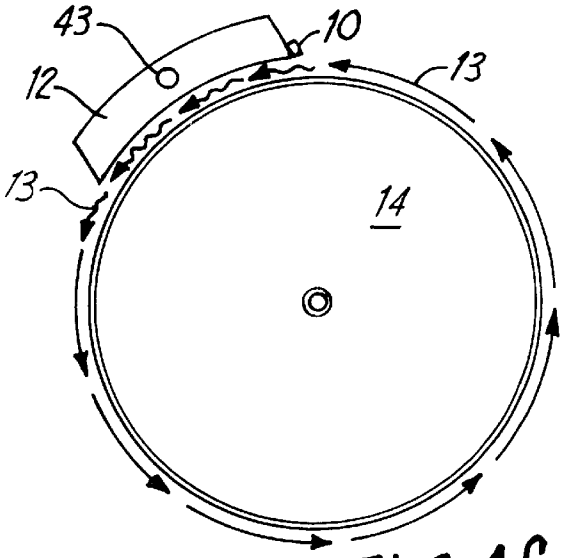
FIG. 1A, 1B, and 1C depict an embodiment of the present invention wherein a single flow obstruction coupled to a leading edge of a print carriage redirects satellite droplets expelled into a region present between the nozzles and the print media.
Figure 1B:
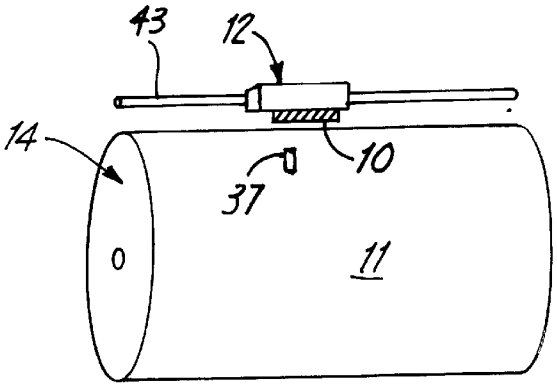
Figure 1A:
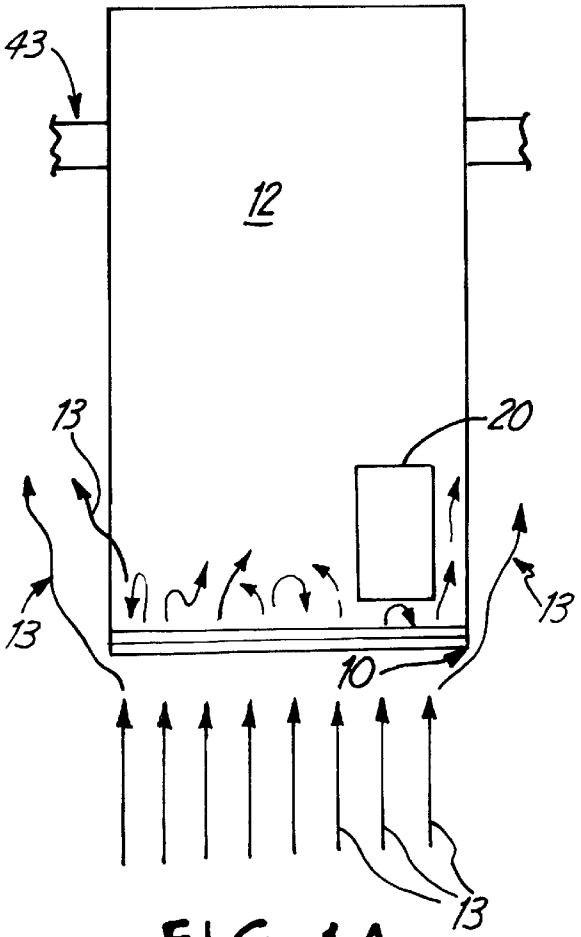
Figure 2C:
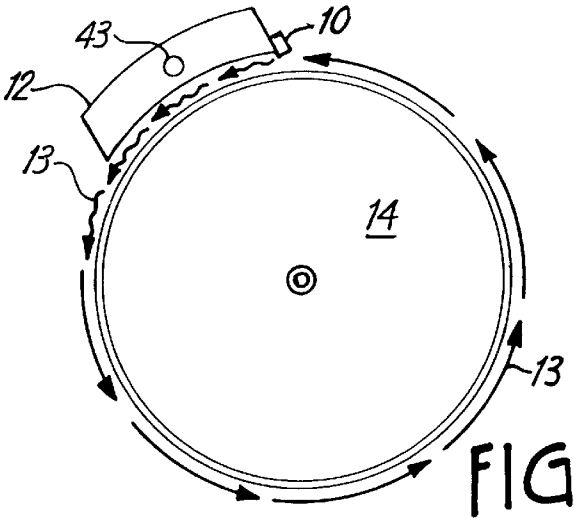
FIG. 2A, 2B, and 2C depict an embodiment of the present invention wherein a single combined flow obstruction member and fluid plenum receives fluid from a leading edge of a print carriage before it reverses and redistributes said fluid as a counterflow fluid to influence satellite droplets present between the nozzles and the print media.
Figure 2B:
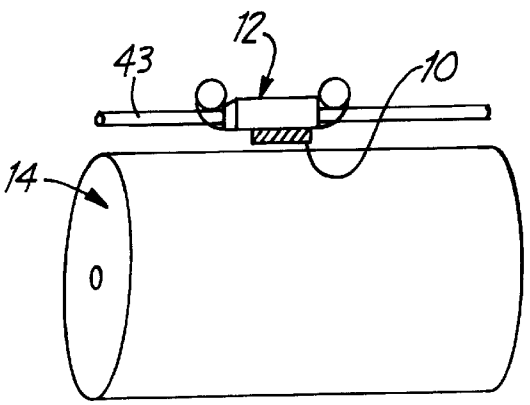
Figure 2A:
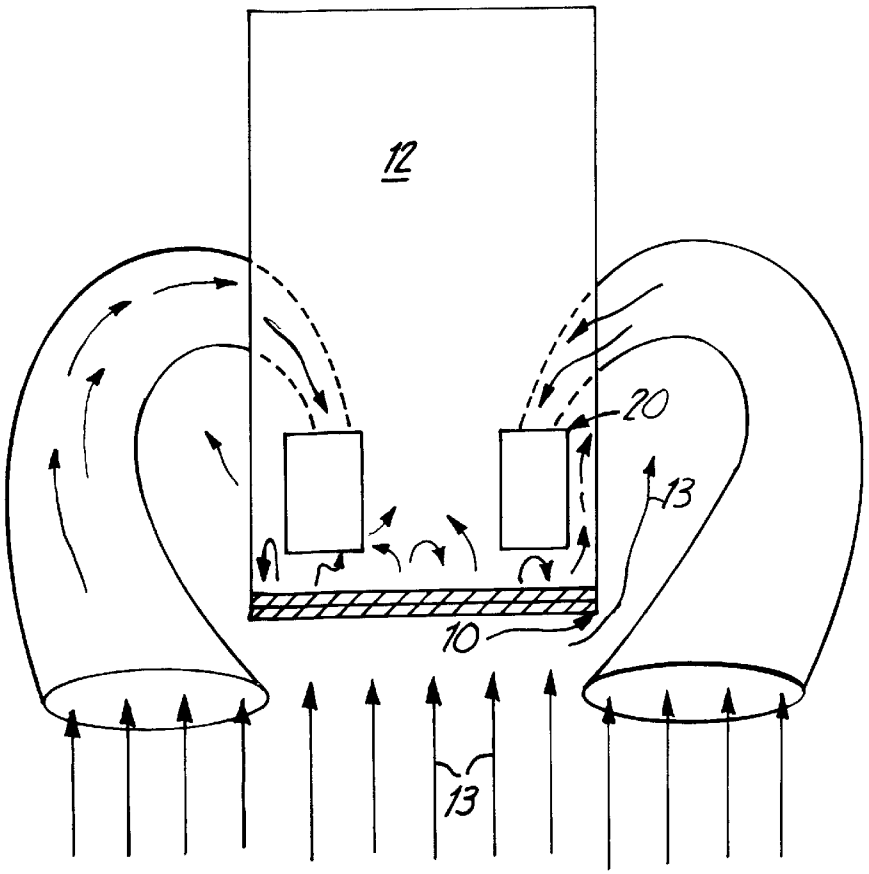
Figure 3C:
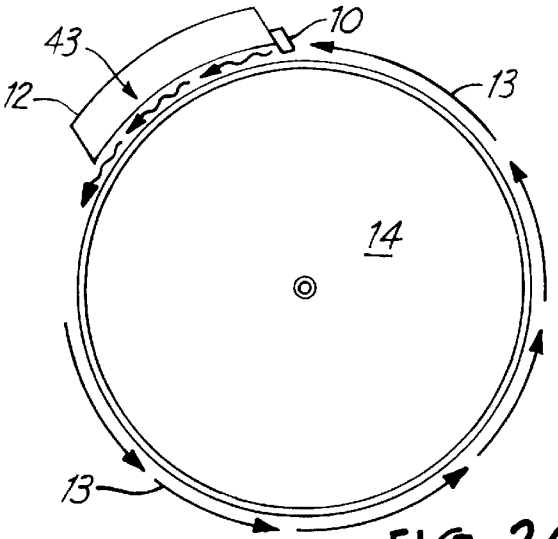
FIG. 3A, 3B, and 3C depict an embodiment of the present invention wherein a multiple member flow obstruction couples to both a leading edge of a print carriage and a carriage support or drive member to both redirect fluid from the leading edge of the carriage and to collect and redistribute unobstructed fluid from an area adjacent to the carriage to influence satellite droplets as a result of fluid cooperation among the obstructions.
Figure 3B:
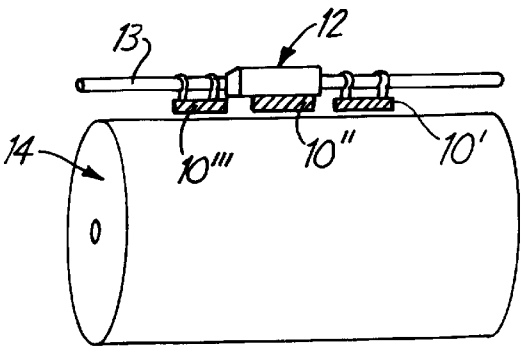
Figure 3A:
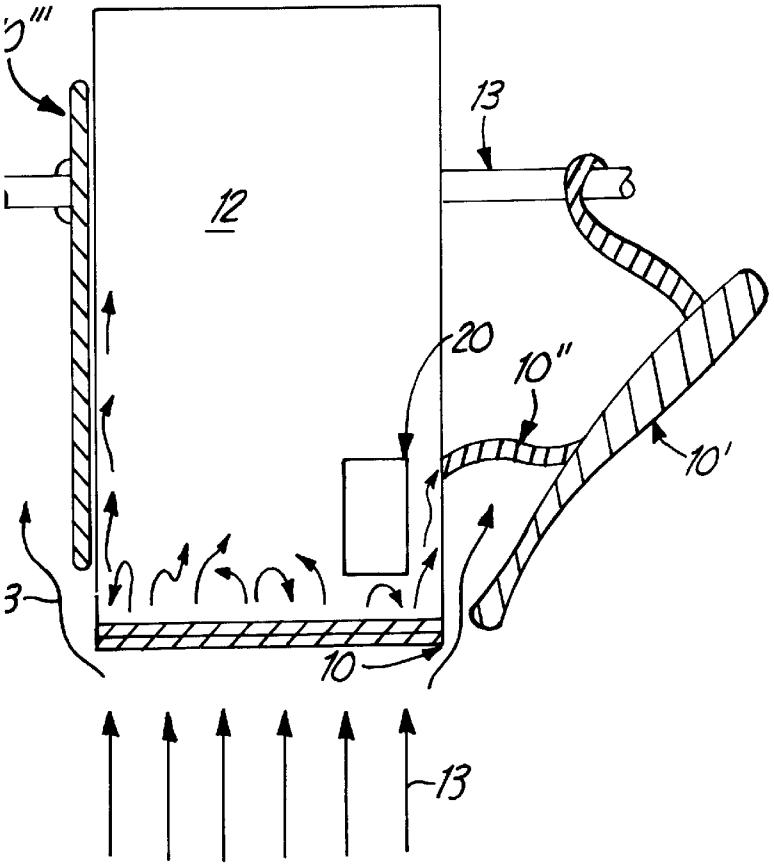

Referring now to portions A, B, and C, of each FIG. 1, 2, and 3, various embodiments of a passive chaotic flow-inducing member 10 is shown adjacent a portion of a carriage assembly 12 which in turn reciprocates along an axis defined by a lead screw 43 evenly spaced from a drum (platen) 14 which holds an ink receiving print media 11. In operation the member 10 interrupts air flow adjacent the print substrate and the carriage assembly 12 and owing to the shape and dimension of the member 10 such air flow then positively interacts with a print substrate marking material which is emitted from a plurality of nozzles 19 of least one print head 20 under direction of control circuitry 22 on carriage board 25 (in turn coupled to system electronics of print engine 100—not shown) so that primary droplets 15 of the marking material contact the print media 11 at preselected positions to thereby create an image. In FIG. 2, the member 10 comprises a hollow passageway having a first end to capture ambient air upstream of the carriage assembly 12 and redirect the ambient air through a 180 degree radius turn to a downstream portion of the carriage assembly 12 to counteract the incoming ambient air flow and thus the satellite droplets 17 encounter a common, chaotic flow environment which operates to influenced and decrease Overspray. In FIG. 3, two additional flow-inducing members 10' and 10", or alternatively a single additional member 10'", are depicted oriented adjacent the carriage 12 and member 10 so that the air flow at the surface of the platen 14 are further conditioned to interact on the downstream portion of the carriage assembly 12.

Figure 4:
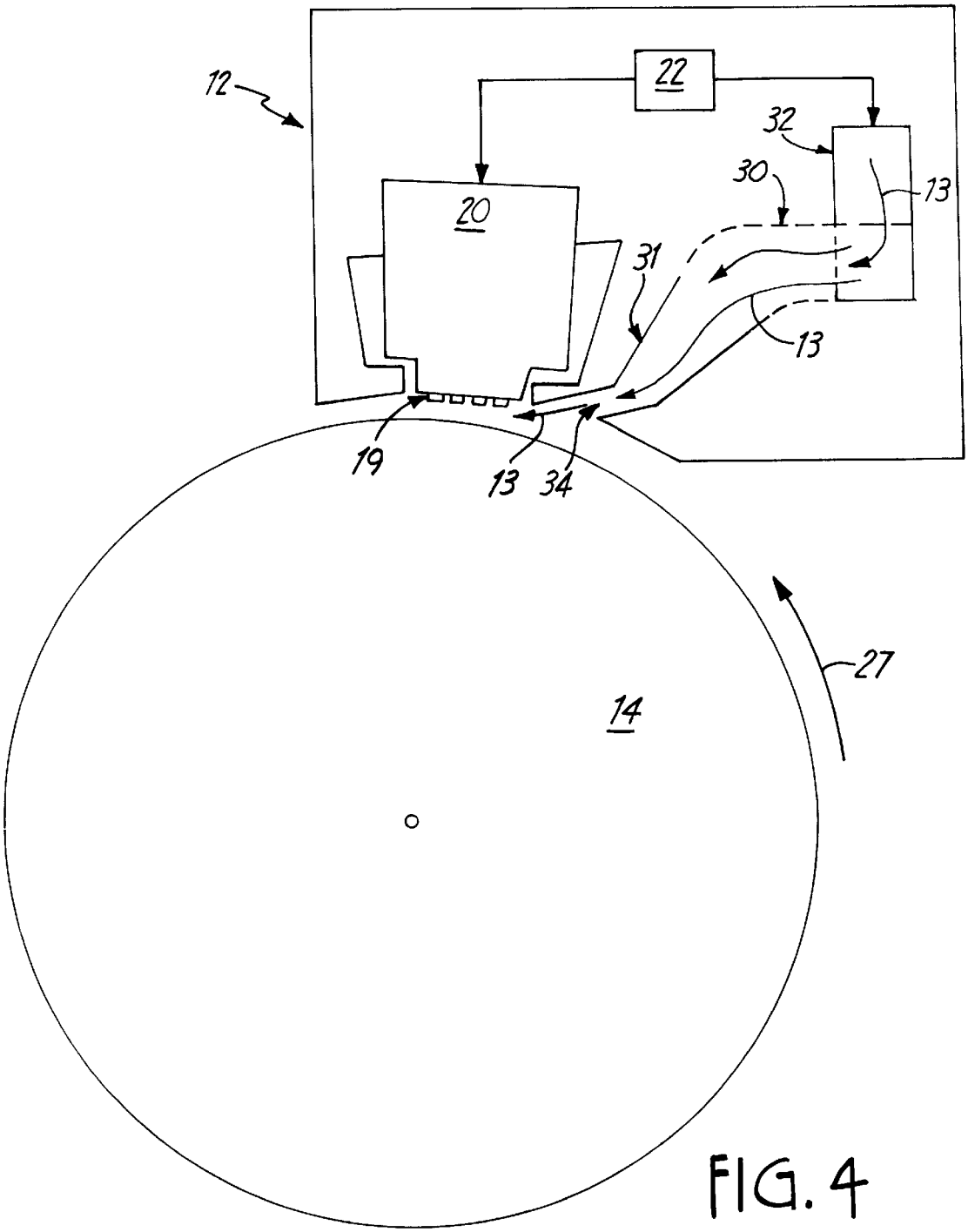
FIG. 4 depicts an embodiment of a suitable active satellite redistribution mechanism wherein a source of fluid flowing at a preselected velocity is present at the leading edge of the carriage and expels the fluid to influence satellite ink droplets.

Referring to FIG. 4, a carriage assembly 12 having a member 10 coupled to the upstream side of carriage 12 further includes fluid passageway 30 fluidly coupled to a source of fluid pressure 32 and continuing to passageway portion 31 and terminating at a fluid exit port 34 disposed on the carriage 12 proximate the nozzles 19 of the print head 20. Although not depicted in FIG. 4, the fluid pressure source 32 can fluidly couple to either an upstream or a downstream exit port 34 (relative to print head 20), which may be integrally formed, detachable, removable, and/or reconfigurable, to thereby create a zone of fluid influence proximate the print media and the print head 20 to thus decrease incidence of satellite droplets 17 during controlled printing operations. While not depicted, a simple hollow length of piping material ported to a source of fluid pressure and having apertures formed through its exterior surface at select locations can effectively provide fluid to ameliorate satellite droplets 27. Such a length of piping may be efficiently used to help pinpoint the most advantageous locations for locating fluid exit ports 34 in an iterative development process for a new or improved carriage assembly 12 having integrally formed exit ports 34 (as in FIG. 10).

The inventors noted that if the average velocity of the fluid flow from exit ports 34 increases above a certain magnitude it thereby creates a reasonably consistent flow pattern, a second image quality defect may manifest itself. This image quality defect is termed "Prespray," wherein tiny ink droplets (usually smaller than the satellite droplets which create Overspray) appear to be widely dispersed and record upon the printing media as much as three-eighths of an inch (⅜) upstream of primary marks formed from the primary droplets 15. This Prespray effect was observed when the inventors attempted to utilize relatively reduced-size exit ports 34. These smaller exit ports 34 were shown to have a much smaller zone of fluid influence and an uneven velocity profile proximate the nozzles 19. Thus, the inventors believe that relatively larger exit ports 34 exhibit a more stable, common-magnitude fluid exit velocity and also have a much more consistent fluid velocity profile over a larger zone of fluid influence. More precisely, the inventors have found that the relatively larger exit ports 34 provide a more desirable fluid flow 13, and do not cause the Prespray image defect just described. The inventors also note that dot-to-dot registration is not typically adversely affected by the implementation of the present invention. However, since maintaining accurate registration among and between the nozzles of the print heads is required at all times during printing in order to print high quality text and graphic images (as known and used in the art—registration and calibration gutter patterns) the inventors note that registration can be off set due to a too high velocity fluid stream applied in conformity with the teaching of the present invention. In sum, the inventors believe that either an inconsistent fluid flow 13, or a velocity of the fluid flow that is too high seems to increase Prespray, and can create other undesirable image defects to the detriment of the primary goal in the genesis of the present invention, improved text clarity, graphics definition, and color fidelity. Although iterative testing and/or computational techniques will rapidly assist in the process of effectively implementing the present invention any said Prespray effect(s) should be monitored and avoided in said process.

Figure 5:
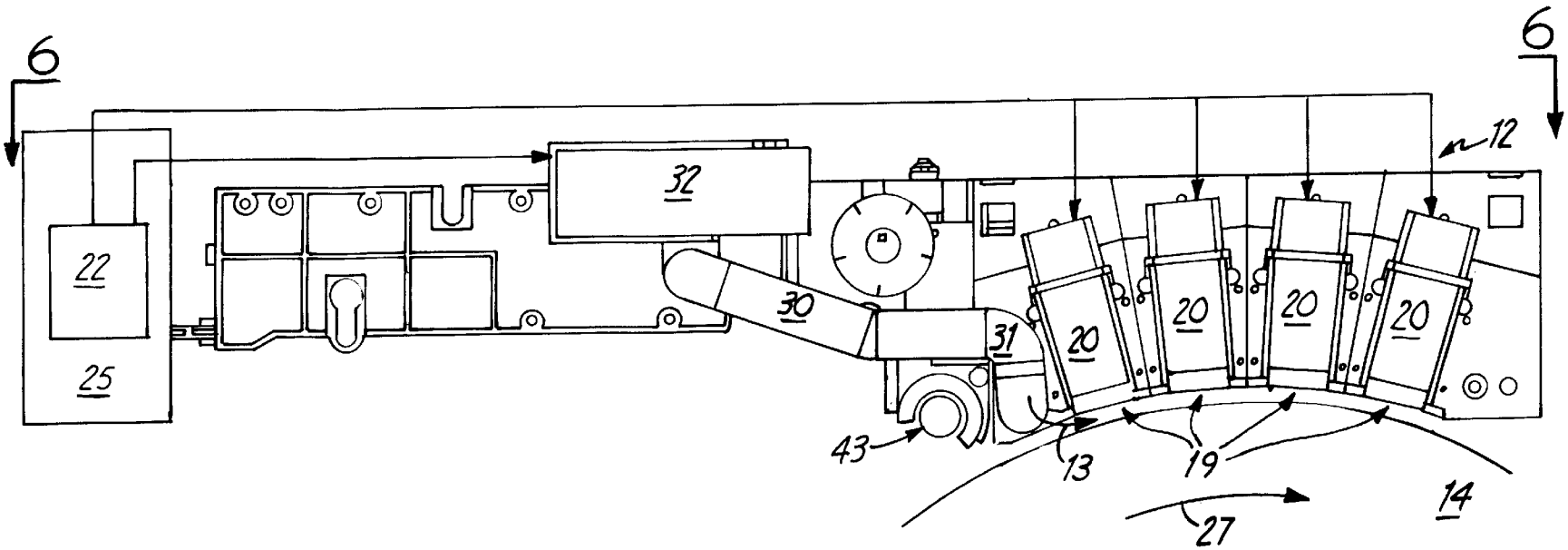
FIG. 5 is an elevational side view depicting an embodiment of the present invention implemented on an eight print head carriage assembly.

Referring now to FIG. 5, which depicts a detailed elevational side view of an embodiment of the present invention implemented on an eight print head carriage assembly 12, the control circuit 22 on circuit board 25 couples to the blower fan 32 and each print head 20 so that satellite droplets 17 emitted from the nozzles 19 of the print head 20 during printing operations are suitably deflected in the zone of fluid influence. An arrow identified by reference numeral 27 indicates the direction of rotation of the drum member 14 (and therefore printing media 11, not depicted).

Figure 6:
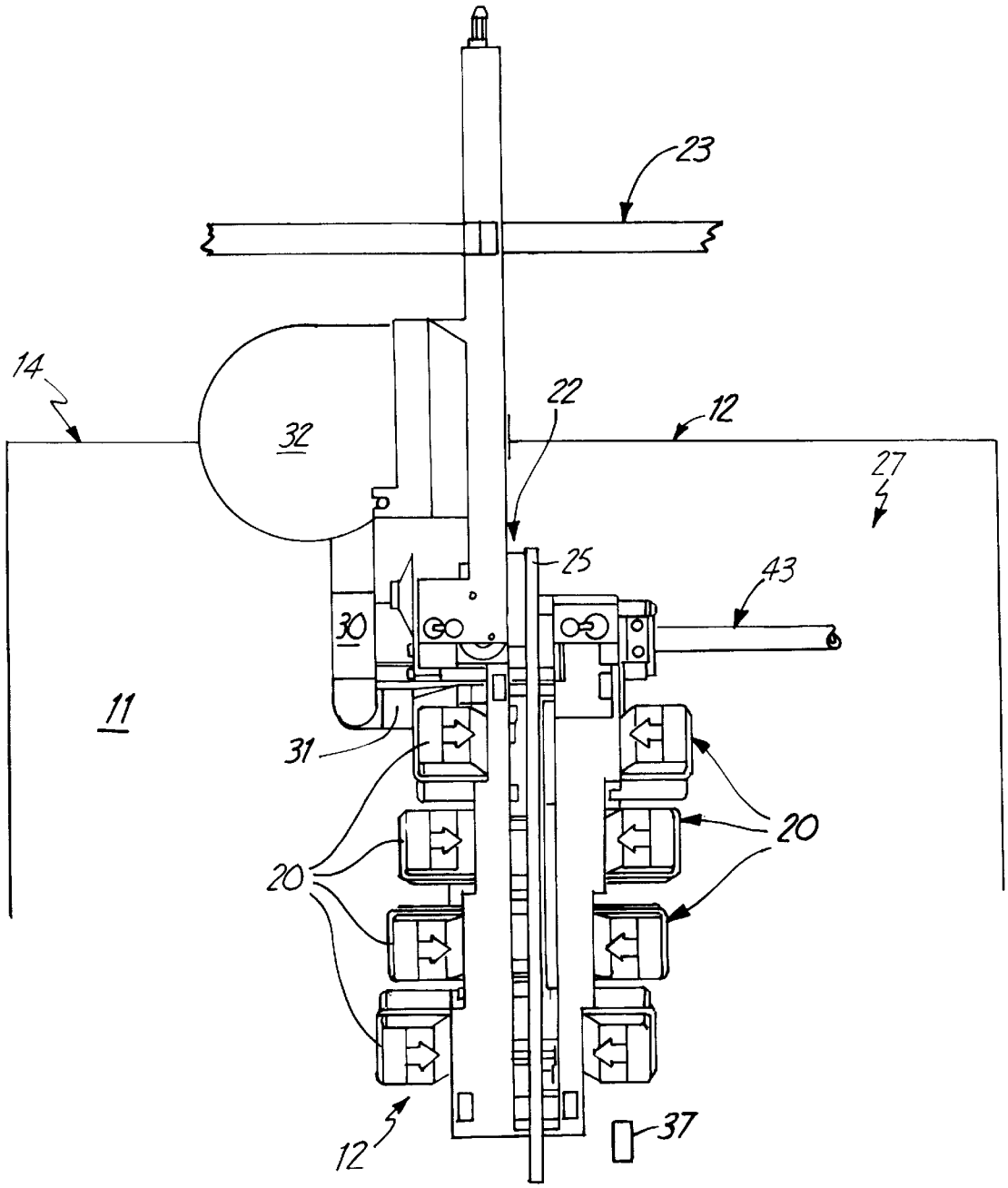
FIG. 6 is a plan view of the print head carriage assembly embodiment of the present invention depicted in FIG. 5 along lines 6—6.
Figure 7:
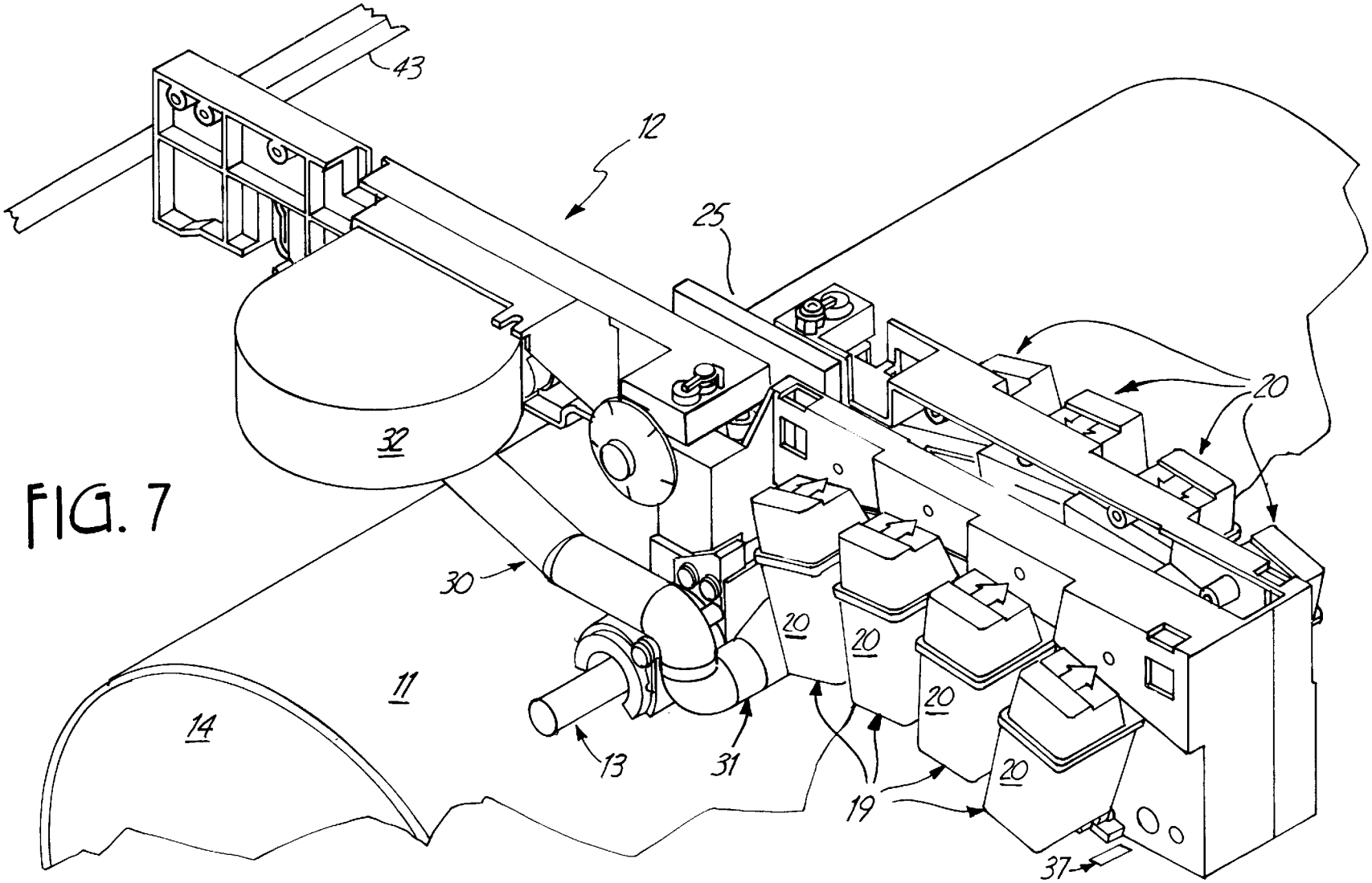
FIG. 7 is a perspective view of the print head carriage assembly embodiment of the present invention depicted in both FIG. 5 and FIG. 6.
Figure 8:
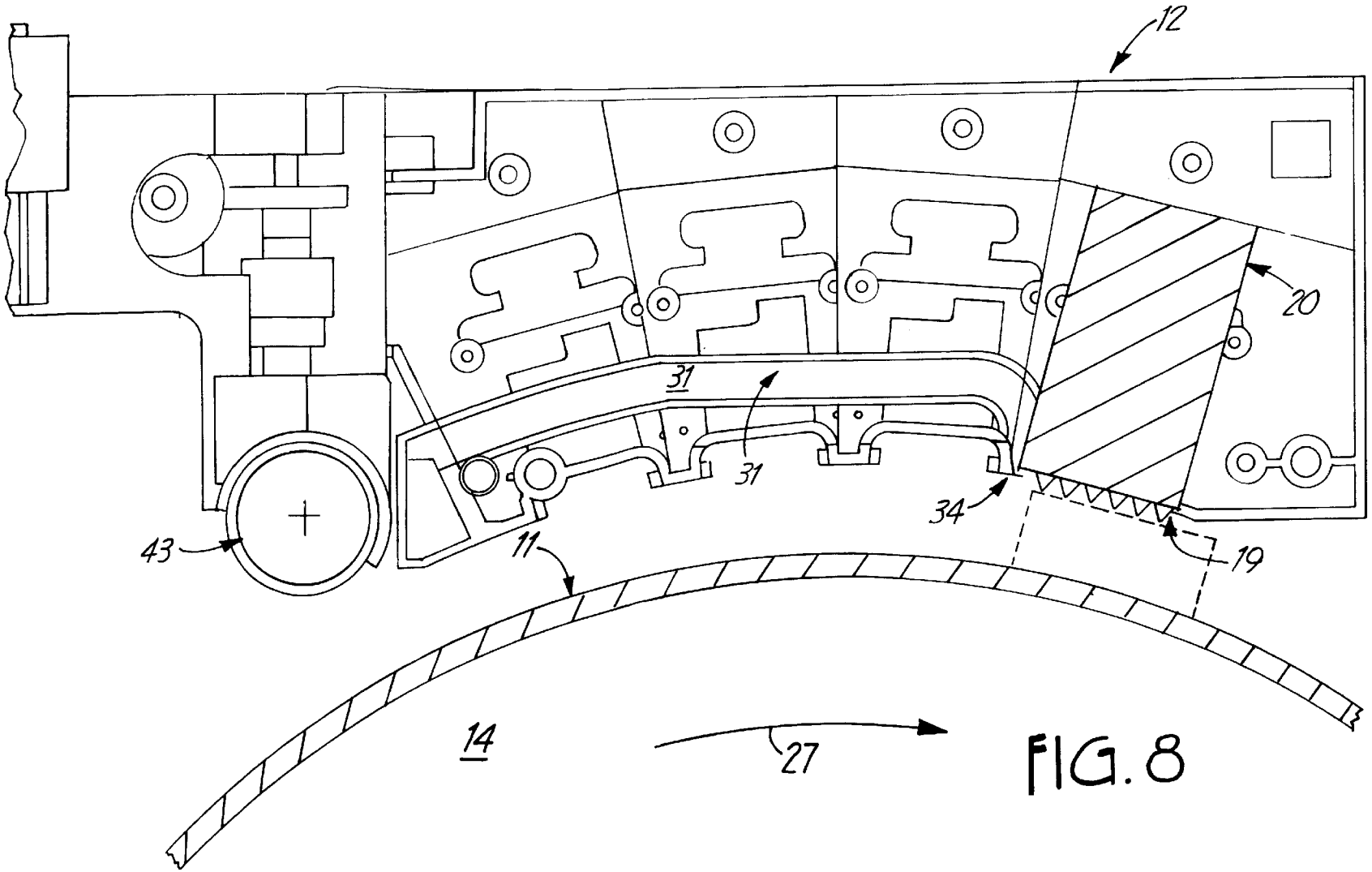
FIG. 8 is an elevational side view in cross section of at least one interior fluid passageway of the carriage assembly embodiment of FIG. 7.

Referring to FIG. 6, a plan view of the print head carriage assembly 12 embodiment of the present invention depicted in FIG. 5 along lines 6—6, illustrates an embodiment having eight print heads 20 oriented upon the carriage assembly 12. In addition, a compact and integrated source of fluid pressure 32 is disposed on the carriage assembly 12 in a location to minimize vibration and to help balance the center of gravity of the carriage assembly 12 with respect to drive screw 43 and linear carriage support 33. FIG. 7 shows a perspective view of the print head carriage assembly 12 embodiment depicted in both FIG. 5 and FIG. 6 and illustrates the orientation of each print head 20 to each other print head 20. Because of the proximity of the print heads 20 to each other discrete Overspray compensation for an "upstream" print head 20 provides a measure of Overspray compensation to one or more of the "downstream" print heads 20. Accordingly, in one efficient and preferred embodiment, only those colors of emitted ink that are readily ascertainable to a human viewer such as black, heavy concentration magenta and cyan inks, or other similar relatively dark colorant, receive individual fluid flow conditioning to reduce Overspray while the other sources of emitted ink either are not compensated or oriented to benefit only secondarily from the individual high velocity fluid flows of each compensated ink emitting nozzle 19 or droplet source (s). In this preferred embodiment, only the print cartridges 20 which emit the darker marking material thus receive the high velocity fluid flow 13 and only incidental satellite droplet 17 adaptation occurs to the remaining print cartridges 20. One of skill in the art will appreciate that practically all visually perceptible Overspray artifacts arise from satellite droplets 17 of the darkest marking material; for example, black and magenta, and to a lesser degree, cyan inks. Thus, providing a stream of pressurized fluid 13 to each print head 20 that emits such darkest marking material will provide beneficial visual results. Thus, the inventors have found that reasonably acceptable image output nonetheless results with an added advantage of lessened mechanical complexity and lower pressurization requirements since less high-velocity fluid flow 13 is required. Accordingly, as shown in FIG. 8, discrete compensation of only a print head 20 that emits a black, a heavy concentration magenta, and perhaps a heavy concentration cyan ink maximizes the benefits and contains costs of practicing the present invention. In FIG. 8, which is an elevational side view in cross section of at least one interior fluid passageway 30 of the carriage assembly 12 of the embodiment depicted in FIG. 7, an extension passageway 31 fluidly coupled to passageway 30 conveys the pressurized fluid 13 to one or more print heads 20 disposed at the distal end of carriage assembly 12 is shown porting the pressurized fluid through extension passageway 31 of the passageway 30, so that at a fluid exit port 34 the pressurized fluid 13 is converted to an increased velocity fluid flow 13 which is preferably expelled as close to the upstream side of the nozzles 19 of print head 20 to maximize the effectiveness of the pressurized fluid stream upon the satellite ink droplets 17 in the zone of fluid influence.

When using ambient air in a drum-based digital print engine 100 the inventors have found that given a drum rotation of approximately 70 ips a velocity of the ambient air at each terminus of a plurality of fluid passageways (as measured by an analog anemometer) should be between 210 ips and 280 ips. For reference, 280 ips equals 1400 feet per minute, and by contrast, a 30 ips drum speed dictates that a velocity of ambient air should range between 90 ips and 110 ips to create the desired effect when practicing the present invention. The inventors have further discovered that the height of the nozzles 19 above the printing media 11, is relatively independent of the effects of the directed fluid flow 13 of the present invention (i.e., it still works). For further reference, a nominal print head height of 45–55 mils with respect to the printing media 11 was used for the data reported immediately above. Finally, a preferred embodiment of the present invention includes a manually variable print head height adjustment device (not shown) so that use of print media(s) 11 of differing thickness can be accommodated, and relatively stable satellite droplet 17 trajectory profiles are maintained for such variety of printing media with a spacing, or print head height, of approximately 0.050".

Other embodiments of the present invention include use of at least one flow inducing member 10 to further condition and adapt the flow of air adjacent the drum 14 created simply by rotation of the drum 14. This embodiment is shown in FIG. 1, 2, and 3 and may be applied both alone and in conjunction with the pressurized source of fluid 32 embodiments depicted herein. Also, a suitably ported vacuum source can serve a similar function as the preferred use of a source of positive pressure 32 to create a fluid flow 13 having a velocity sufficient to effectively influence satellite droplets 17, and both variations are expressly covered hereby (and may be best utilized in bi-directional printing swath-type print engines). Further, alternating use of both a source of vacuum and a source of positive pressure in conjunction or combination is viewed as merely another embodiment of the invention herein described, depicted, and enabled to one of skill in the art. Also, while not depicted herein, a detachable, removable, and/or reconfigurable length of piping may be coupled to the distal end of a length of flexible tubing (passageway extension 31) so that pre-existing print engines may be converted to utilize the apparatus and method of the present invention without significant re-engineering or rework.

One of skill in the art will recognize that different size and shape exit ports 34 may be used to achieve the desired results. Complex flow analysis, applying concepts such as those of modem computational fluid dynamics, will surely reveal numerous alternatives covered hereby. Further, any device that operates to convert an internally retained pressurized fluid to an externally vented high velocity fluid flow will suffice in lieu of the described source of pressurized fluid 32.

Figure 9:
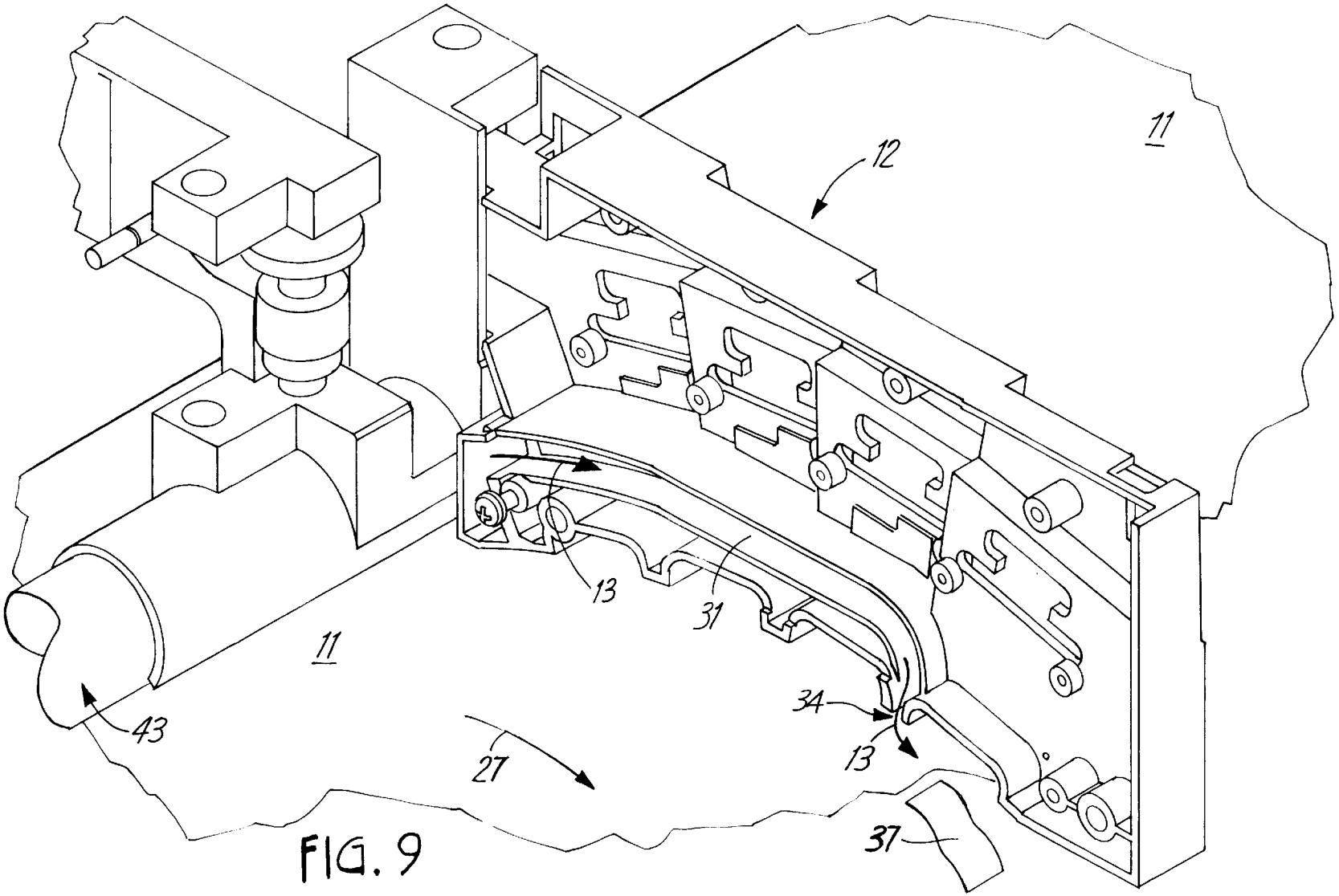
FIG. 9 is a perspective view of a portion of the carriage assembly embodiment shown in cross sectional view in FIG. 8.

Referring now to FIG. 9, a perspective view of a portion of the carriage assembly 12 shown in cross sectional view in an embodiment depicted in FIG. 8 clearly shows one iteration of the internal passageways 30,31 noted above in reference to FIG. 8, although other fluid porting channels, piping, or flexible tubing may of course be substituted in lieu of the internal passageways depicted herein.

Figure 10:
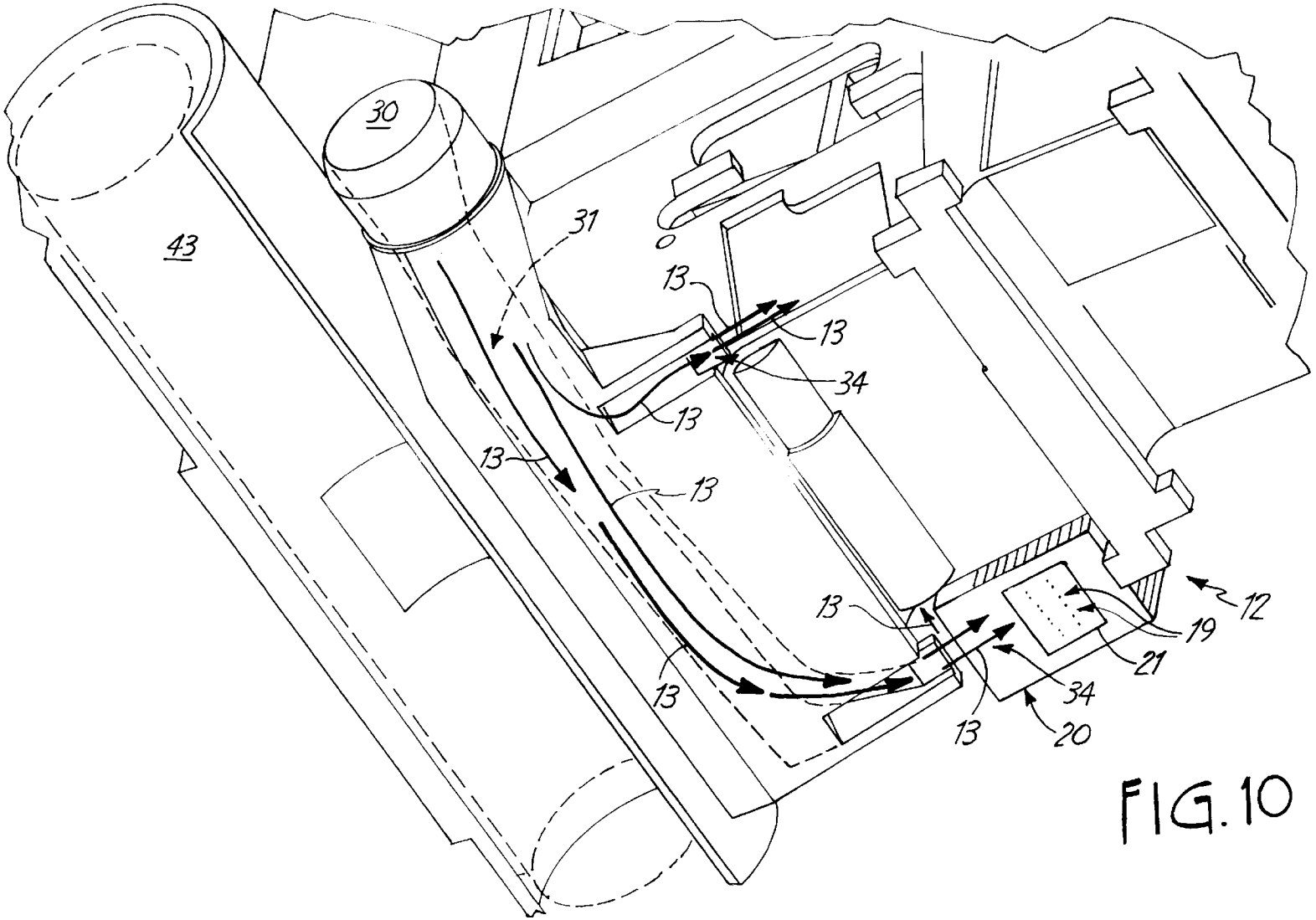
FIG. 10 is an enlarged perspective view of the lower portion of the carriage assembly embodiment of the present invention depicting at least two fluid exit ports.

Referring now to FIG. 10, an enlarged perspective view of the lower portion of the carriage assembly 12 embodiment of the present invention depicting at least two fluid exit ports 34 with a preferred size and shape, although same may, and perhaps should be altered or customized to maximize the beneficial effects for a chosen print head 20. The embodiment shown in FIG. 10 has been optimized for a print head manufactured by Hewlett-Packard Company, the model number 51626A disposable thermal ink jet cartridge. This model ink jet cartridge has a printing area denoted by hatched area 37 on drum 14 as shown in FIGS. 1, 2, 3, 7, and 9, which printing area 37 is defined by ink emitted from two rows of discrete ink emitting nozzles 19. The fluid exit ports 34 are sized to provide pressurized fluid over the entire longitudinal width of said area 37 which thereby define an area of fluid influence over the ink emitted from nozzles 19. Because the carriage assembly 12 of a preferred embodiment of the FIG. 10 is offset slightly so that no two print heads 20 print ink on the same y-axis (orthogonal to the axis of rotation of the drum), the effects of the pressurized fluid upon downstream print head(s) 20 is not too significant, and can be difficult to ascertain with the naked eye. Although the inventors believe that revising the size and shape of the exit ports 34 will create an effective Overspray compensation result on such downstream print heads 20, without altering the original offset orientation of such print heads 20. The inventors have also confirmed the effectiveness of the present invention when the nozzles 19 of cartridge 20 comprise three hundred (300) nozzles in each print cartridge 20 disposed in carriage assembly 12, such as those manufactured by Hewlett-Packard Company as the model 51645A and other related cartridge model series.

The type of fluid flow velocity generating device 32 may be selected from a large variety of commercially available fans such as open or ducted fans, centrifugal fans, radial fans; although the inventors prefer to utilize a ducted centrifugal fan. Furthermore, for the preferred fluid flow 13 velocities needed to practice the present invention, it is very feasible to utilize multiple fans, in a series or a parallel configuration so long as an objective of one embodiment of the present invention is satisfied; namely, maintaining a relatively constant fluid exit velocity for each of a plurality of similarly sized fluid exit ports 34. Although a variety of blower fan mechanisms 32 should operate effectively when practicing the present invention, the inventors prefer a blower fan assembly manufactured by Gamma Sanyodenki, as the model 30 Series mini brushless dc centrifugal blower fan rated at twenty five cubic feet per minute (25 cfm) from a housing measuring approximately 100 mm in diameter and 33 mm in width. This blower fan 32 is light weight and compact and easily adapted to mechanically, fluidly, and electrically couple to a wide variety of traditional print head assemblies for digital print engines. The blower fan assembly 32 is preferably disposed upon the carriage assembly 12 which is preferably coupled to lead screw 43 on vibration-damped fittings (not shown) and parallel support rail 33 for additional stability. Furthermore, the blower fan 32 should preferably be disposed as close as possible to the center of mass of the reciprocating carriage assembly 12. Although not depicted herein, the inventors hereto contemplate remotely coupled sources of pressurized fluid, where constraints on size, weight, and electrical efficiency do not necessarily control or otherwise limit design freedom. Furthermore, the inventors hereto also contemplate practicing the present invention with a locally disposed disposable source of pressurized fluid material. In this embodiment, the pressurized fluid 13 will either augment a second source of pressurized fluid or itself provide the sole source to create the needed fluid velocity at exit port 34. As earlier mentioned, this source of pressurized fluid is preferably ambient air, but may also comprise heated, cooled, purified, highly filtered fluid, and/or a combination of same, and the fluid 13 could furthermore comprise a reactive or an inert fluid. The inventors also believe that a pre-heated fluid 13, or a reactive-type fluid finds utility in drying or curing certain types of a variety marking material capable of being emitted from the nozzles 19. An inert fluid might be used so that a marking material otherwise susceptible to reacting with ambient air can be printed in multiple passes of the carriage assembly 12 and thus, the nozzles 19, without altering the appearance of adjacent printed swaths of primary droplets 15. A person of skill in the art will recognize that use of a ducted fan 32 is merely one manner of creating the necessary velocity of fluid 13 at the exit ports 34. As is known and well understood in the art, the relationship between fluid velocity and pressure inside a ducted fan 32 illustrates how relatively high pressure generated internal to the fan 32 is converted into rapidly increasing fluid velocity when the fluid 13 departs from the exit ports 34.

While not a primary objective of the present invention, the inventors have also discovered that use of the blower fan 32 of the preferred embodiment need not be suspended during periodic cleaning of the nozzles 19. In fact, during testing of the present invention, the inventors found that continued application of fluid flow 13 to the nozzles 19 during continued emission of ink marking material resulted in a decreased need to take affirmative recovery measures for nozzle 19 after extended operation. The inventors now conclude that in one particular embodiment it does not matter whether or not the blower 32, or other source of fluid flow 13, continues to operate during servicing operations such as emitting ink into a small receptacle, wiping the surface of the nozzles, and capping the nozzles 19 during temporary halts in printing. The inventors suggest that the fluid flow flows ink dust away from the nozzles during a "spitting" operation typically used to clear the nozzles 19. During internal testing of nozzles 19 in conjunction with a semi-automated nozzle servicing station, the inventors noted that the viability of nozzles 19 is preserved much longer when the testing was conducted with the applied fluid 13 flowing in accordance with the present invention.

As can be appreciated, the spacing between the nozzles 19 and the printing media 11 directly impacts the incidence of Overspray, but to a lesser degree the effectiveness of the Overspray control of the present invention. It has been observed that as the spacing between the nozzles 19 and the printing media 11 decreases, Overspray decreases. Accordingly, the inventors have observed that if the velocity of the fluid flow 13 remains constant and the spacing between the nozzles 19 and the printing media 11 is increased, the Overspray is reduced, but not entirely eliminated. The inventors believe that for print engines having adjustable nozzle, or print head, spacing from the printing media, an increasing fluid velocity at the exit ports 34 is needed to yield an appreciable difference in image quality as the spacing increases. Likewise, the inventors suspect that the relative velocity of the nozzles with respect to the printing media may affect satellite droplet formation, and therefore, Overspray. Thus, the inventors believe that for low velocity, high quality printing modes Overspray appears to decrease without additional fluid supplied to the nozzles; however, when pressurized fluid is applied to the nozzles a decrease in Overspray was noted. Furthermore, the inventors note that certain ink formulations, such as low viscosity or low surface tension formulations, are significantly more susceptible to Overspray.

The following examples are intended as illustrative of various embodiments of the present invention and are not meant to limit application(s) of the teaching of the present invention in any way whatsoever.

EXAMPLE 1

A method of printing on a substrate in a digital ink jet print engine, comprising the steps of:

energizing a fluid pressurization apparatus to expel fluid from at least one exit port adjacent an ink emitting nozzle;

supplying a drive pulse to said ink emitting nozzle; and advancing a printing media with respect to said exit port and said ink emitting nozzle.

EXAMPLE 2

A method of printing upon a substrate attached to a rotating drum, comprising the steps of:

applying a fluid deflector member adjacent and upstream from an ink emitting surface of an ink jet print head;

spinning a rotating drum having a printing substrate attached to an exterior surface of the rotating drum in a direction to cause ambient fluid to circulate in a first direction around the drum so that the ambient fluid first interacts with the fluid deflector and then interacts with the print head; and, energizing the print head so that ink is expelled therefrom in a controlled manner.

EXAMPLE 3

A method of printing on a substrate in a digital drum-based ink jet print engine, comprising the steps of:

rotating a drum member at a preselected rotational velocity, wherein the drum member has a printing media attached to an exterior surface thereof and said printing media is closely spaced from an ink emitting nozzle;

expelling a fluid from at least one exit port adjacent the ink emitting nozzle at a linear velocity three to five times (3× to 5×) the rotational velocity of said drum member; and supplying a drive pulse to said ink emitting nozzle;

EXAMPLE 4

An improved apparatus for printing digital images upon a substrate attached to a rotating drum and opposing a carriage assembly having a plurality of ink jet print cartridges disposed thereon, said improvement comprising:

a fluid passageway coupled to the carriage assembly, wherein the fluid passageway has a fluid receiving port at a first end, a fluid conveying portion in a middle portion, and a fluid exit port at a second end;

a blower fan assembly fluidly coupled to the fluid receiving port; and wherein the fluid exit port is disposed in close proximity to at least one ink emitting nozzle of one of a plurality of ink jet print cartridges so that a fluid material emitted from said at least one ink emitting nozzle conditions a plurality of ink satellite droplets.

EXAMPLE 5

A method of printing with electrically actuated ink emitting nozzles used in a multi-pass digital full color, drum-based print engine, to minimize undesired banding, incorrect coloring, and to minimize other undesirable visual artifacts, comprising the steps of:

rotating a drum member at a first rotational velocity;

applying a fluid flow at a second velocity of a magnitude at least twice the first velocity, to a space having a volume defined by a portion of a rotating print substrate that opposes an ink emitting surface of at least one print head; and emitting a marking material from the at least one print head.

EXAMPLE 6

A method of compensating for Overspray image artifacts created by satellite droplets, which are created incidentally to formation of larger primary ink droplets, and that are simultaneously expelled from a print head onto a printing media to form a detailed matrix of printed image pixels, comprising the steps of:

energizing a print head to emit ink droplets from a orifice plate portion of the print head onto an adjacent printing media so that primary ink droplets are emitted toward preselected locations on the printing media and, incidental to the emitted primary ink droplets, a plurality of satellite ink droplets are emitted toward diverse locations on the printing media; and directing a fluid material toward the orifice plate portion of the print head at a velocity at least three times (3×) the magnitude of relative motion between the orifice plate portion and the printing media, wherein the pressurized fluid exits a fluid passageway at a pressure different than ambient air pressure.

Although that present invention has been described with reference to discrete embodiments, no such limitation is to be read into the claims as they alone define the metes and bounds of the invention disclosed and enabled herein. One of skill in the art will recognize certain insubstantial modifications, minor substitutions, and slight alterations of the apparatus and method claimed herein, that nonetheless embody the spirit and essence of the claimed invention without departing from the scope of the following claims.

What is claimed is:

1. A method of ink jet printing in a digital print engine, comprising the steps of:

moving a plurality of ink jet cartridges, wherein each of said ink jet cartridges has a set of ink emitting nozzles, at a first velocity and in a first direction relative to a printing media;

supplying a satellite drop deflecting fluid to each of said plurality of ink jet cartridges at a second velocity equal to or of greater magnitude than said first velocity and in a second direction opposite to said first direction; and energizing each of said plurality of ink jet cartridges so that said set of nozzles so that a marking material is expelled from some of said set of nozzles on a drop-on-demand basis.

2. The method of claim 1, wherein the marking material is an aqueous ink material and the satellite drop deflecting fluid is ambient air and the ink emitting nozzles emit ink due to a plurality of thermal energy pulses, wherein each of said plurality of thermal energy pulses are directed proximate at least one of said set of said ink emitting nozzles.

3. The method of claim 2, wherein the source of the drop deflecting fluid is a blower fan assembly disposed on a portion of a carriage assembly of the digital ink jet print engine so that the drop deflecting fluid emanates from at least two exit ports of said blower fan assembly and impinges upon the set of said ink emitting nozzles of each one of said plurality of ink jet cartridges and the second velocity is at least two times the first velocity.

4. The method of claim 1, wherein a spacing between the set of ink emitting nozzles and the printing media is less than one-tenth of an inch.

5. The method of claim 4, wherein each of said plurality of ink jet cartridges has at least forty-eight individual ink emitting nozzles and each said at least forty-eight nozzles are all fluidly coupled to a common source of aqueous marking material.

6. An apparatus for compensating for satellite ink doplets emitted from an ink emitting print device, the apparatus comprising:

at least six ink jet print head cartridges coupled to a reciprocating carriage assembly;

an energization circuit means for providing an excitation signal which emits droplets of a marking material from a nozzle portion of the at least six ink jet print head cartridges;

a support means for supporting a print substrate closely spaced from the nozzle portion and oriented to receive the marking material emitted from the nozzle portion of the at least six ink jet print head cartridges;

a fluid velocity generating means for creating a fluid flow; and a fluid passageway, having a first end coupled to the fluid pressurization means and a second end coupled to at least two fluid exit ports, wherein said at least exit ports each terminate at two spaced apart locations on the reciprocating carriage assembly so that the fluid flow exiting the at least two exit ports at the spaced apart location impinges upon the nozzle portion of each of said at least six ink jet print head cartridges.

* * * * *